US006668750B1

(12) United States Patent
Walz et al.

(10) Patent No.: US 6,668,750 B1
(45) Date of Patent: Dec. 30, 2003

(54) FLAG POLE HOLDER

(75) Inventors: James Walz, 425 Buchanan Ave. #502, Cape Canaveral, FL (US) 32920; Mary Beth Walz, Cape Canaveral, FL (US)

(73) Assignee: James Walz, Cape Canaveral, FL (US)

( * ) Notice: Subject to any disclaimer, the term of this patent is extended or adjusted under 35 U.S.C. 154(b) by 0 days.

(21) Appl. No.: 10/010,439

(22) Filed: Nov. 8, 2001

(51) Int. Cl.[7] ..... E04H 12/00
(52) U.S. Cl. ..... 116/173; 248/536
(58) Field of Search ..... 116/173, 174, 116/175; 248/515, 516, 534, 538, 539, 536

(56) References Cited

U.S. PATENT DOCUMENTS

| | | | | | |
|---|---|---|---|---|---|
| 744,977 | A | * | 11/1903 | Nourse | 116/173 |
| 756,989 | A | * | 4/1904 | Suhr | 116/173 |
| 1,020,396 | A | * | 3/1912 | Blank | 116/173 |
| 1,295,274 | A | * | 2/1919 | Crichton | 116/173 |
| 1,305,885 | A | * | 6/1919 | Coe | 116/173 |
| 1,312,426 | A | * | 8/1919 | Schmidt | 116/173 |
| 1,736,177 | A | | 11/1929 | Snook | |
| 1,794,873 | A | * | 3/1931 | Thoroman | 116/173 |
| 3,162,409 | A | * | 12/1964 | Straayer et al. | 116/173 |
| 3,315,926 | A | | 4/1967 | Trenda et al. | 248/42 |
| 4,603,652 | A | * | 8/1986 | Thibault et al. | 116/174 |
| 4,649,678 | A | | 3/1987 | Lamson | 52/103 |
| 4,949,525 | A | | 8/1990 | Weaver | 52/720 |
| 5,046,699 | A | | 9/1991 | Perreault et al. | 248/533 |
| 5,070,809 | A | * | 12/1991 | Fox et al. | 116/174 |
| 5,083,395 | A | | 1/1992 | Daniels | 43/27.4 |
| 5,088,681 | A | | 2/1992 | Procaccianti et al. | 248/530 |
| 5,293,889 | A | | 3/1994 | Hall et al. | 135/16 |
| 5,363,607 | A | | 11/1994 | Turturro | 52/40 |
| 5,396,916 | A | | 3/1995 | Boissonnault | 135/16 |
| 5,397,130 | A | | 3/1995 | Brown | 273/348 |
| 5,477,437 | A | * | 12/1995 | Lach | 116/173 |
| 5,518,218 | A | | 5/1996 | Leonard | 248/530 |
| 5,524,856 | A | | 6/1996 | Neely et al. | 248/534 |
| 5,586,517 | A | * | 12/1996 | Willis et al. | 116/173 |
| 6,227,845 | B1 | | 5/2001 | Pillow et al. | 431/343 |
| 6,289,839 | B1 | * | 9/2001 | Flores | 116/173 |
| 6,386,492 | B1 | * | 5/2002 | Brown et al. | 116/173 |
| 2002/0040499 | A1 | * | 4/2002 | Atkinson | 4/496 |

FOREIGN PATENT DOCUMENTS

| | | | | |
|---|---|---|---|---|
| FR | 2622299 A3 | * | 4/1989 | 116/173 |

OTHER PUBLICATIONS www.sandscrew.com, *The Sand Screw,* Jun. 26, 2001, pp. 1–5.

www.consumer–online.com/sandgrabber/home.htm, *Sand Grabber,* Jun. 26, 2001, pp. 1–3.

* cited by examiner

*Primary Examiner*—Christopher W. Fulton
*Assistant Examiner*—Travis Reis
(74) *Attorney, Agent, or Firm*—Brian S. Steinberger; Law Offices of Brian S. Steinberger, P.A.

(57) ABSTRACT

Flag pole holder for attaching to railings on balconies, porches, decks, and stairwells. The holder has a longitudinal pole having a base portion that sits on a floor surface for supporting the weight of the holder and an upper end portion for supporting either or both a flag and a windsock. An angled portion in the pole allows for flag/windsock to hang over the railing. Tie lines such as cords attach the pole to the railings to further stable the holder. Alternatively, or in combination a stand on a support surface such as a ground surface, can be used under the pole for supporting the holder with or without tie lines and plastic clips.

10 Claims, 3 Drawing Sheets

FLAG POLE HOLDER

This invention relates to flags, and in particular to attaching a flag, windsock holder and/or banner to pole holders for balconies and railings.

BACKGROUND AND PRIOR ART

Over the years displaying flags has become popular for holidays, showing support for sports teams, and showing patriotism and for acknowledging events, etc. Multilevel apartments, condominiums, and office buildings have balconies that are difficult to display flags from. Many types of devices have been proposed for supporting either or both flags and umbrellas that cannot be used for balconies. For example, ground based devices for supporting flags have included various types of screws and spikes, that are inserted into the ground, and can not be used for balconies. See U.S. Pat. No. 1,736,177 to Snook; U.S. Pat. No. 4,649,678 to Lamson; U.S. Pat. No. 5,046,699 and 5,088,681 both to Perreault et al.; U.S. Pat. No. 5,293,889 to Hall et al.; U.S. Pat. No. 5,363,607 to Turturro; U.S. Pat. No. 5,396,916 to Boissonnault; U.S. Pat. No. 5,397,130 to Brown; U.S. Pat. No. 5,518,218 to Leonard; and U.S. Pat. No. 5,586,517 to Willis et al.

Other types of devices have also been proposed for mounting flag poles to other surfaces which are also not practical for use on balconies. The Willis '517 patent further describes anchor type devices for mounting flags to the sides of walls. Viden '299 describes a device for mounting flags to moving vehicles such as automobiles.

Few devices exist for easily mounting flag poles to railings especially those found on balconies. For example, U.S. Pat. No. 3,315,926 to Trenda et al. and U.S. Pat. No. 5,524,856 to Neely et al. each describes a railing mounts for flags", that require clamps to be bolted directly to railings to support the flagpole. However, there are inherent problems to using devices such as Trenda '926 and Neely '856. Both patents require the clamp components to directly contact the railings along substantial surface areas that easily cause damage such as but not limited to scratches, nicks, and the like. Additionally both patents have most of the flag poles weight to bear directly on the clamp and associated rail components the clamp is attached to. Thus, the effects of wind, storms, and/or heavy flag poles can also damage the railing components adjacent to the clamps by causing the railings themselves to potentially bend and twist over time. Both patents are limited to supporting the base of the flagpoles. Upper portions of the flagpoles can easily bend and move and are thus not stable when used. Also, none of the cited patents allow for using windsocks to be attached to the flagpoles.

Thus, the need exists for solutions to the above problems.

SUMMARY OF THE INVENTION

A primary objective of the invention is to provide a flagpole holder for balconies that does not damage railings and associated components on the balcony.

A secondary objective of the invention is to provide a flagpole holder for balconies that does not bear the weight of the flagpole on the railing.

A third objective of the invention is to provide a flagpole holder for balconies that allows the floor of the balconies to carry the weight of the flagpole.

A fourth objective of the invention is to provide a flagpole holder for balconies that provides for stability along the entire length of the flagpole.

A fifth objective of the invention is to provide a flagpole holder for balconies that does not require any clamps, and bolts to be used.

A sixth objective of the invention is to provide a flagpole holder for balconies that can easily be assembled and disassembled.

A seventh objective of the invention is to provide a flagpole holder for balconies that allows either or both a flag and a windsock to be supported thereon.

A preferred embodiment of the flag pole holder for railings includes a structure such as a balcony, deck, porch, and stairwell having a hand railing about a portion of the structure, a longitudinal pole having an upper end portion and a lower end portion, the longitudinal pole being attached to the hand railing, and at least one of a flag, a banner, and/or a windsock attached to the upper end portion of the pole, wherein the end portion of the pole is substantially supported by a floor portion of the structure.

The holder can include a second pole connected by an angled connector to the longitudinal pole where the second pole supports the flag, banner, and/or windsock, to overhang outside the structure. The second pole can include two poles telescoping extendable to one another with a locking screw locking a selected extension position. A loop end on the upper telescoping pole allows at least one of the flag, the banner, and the windsock to be attached thereto. Lines attached to the holder allow for the holder to be attached to the adjacent handrail(s) for stabilizing the holder in a selected position, and preventing the holder from twisting and moving over time.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
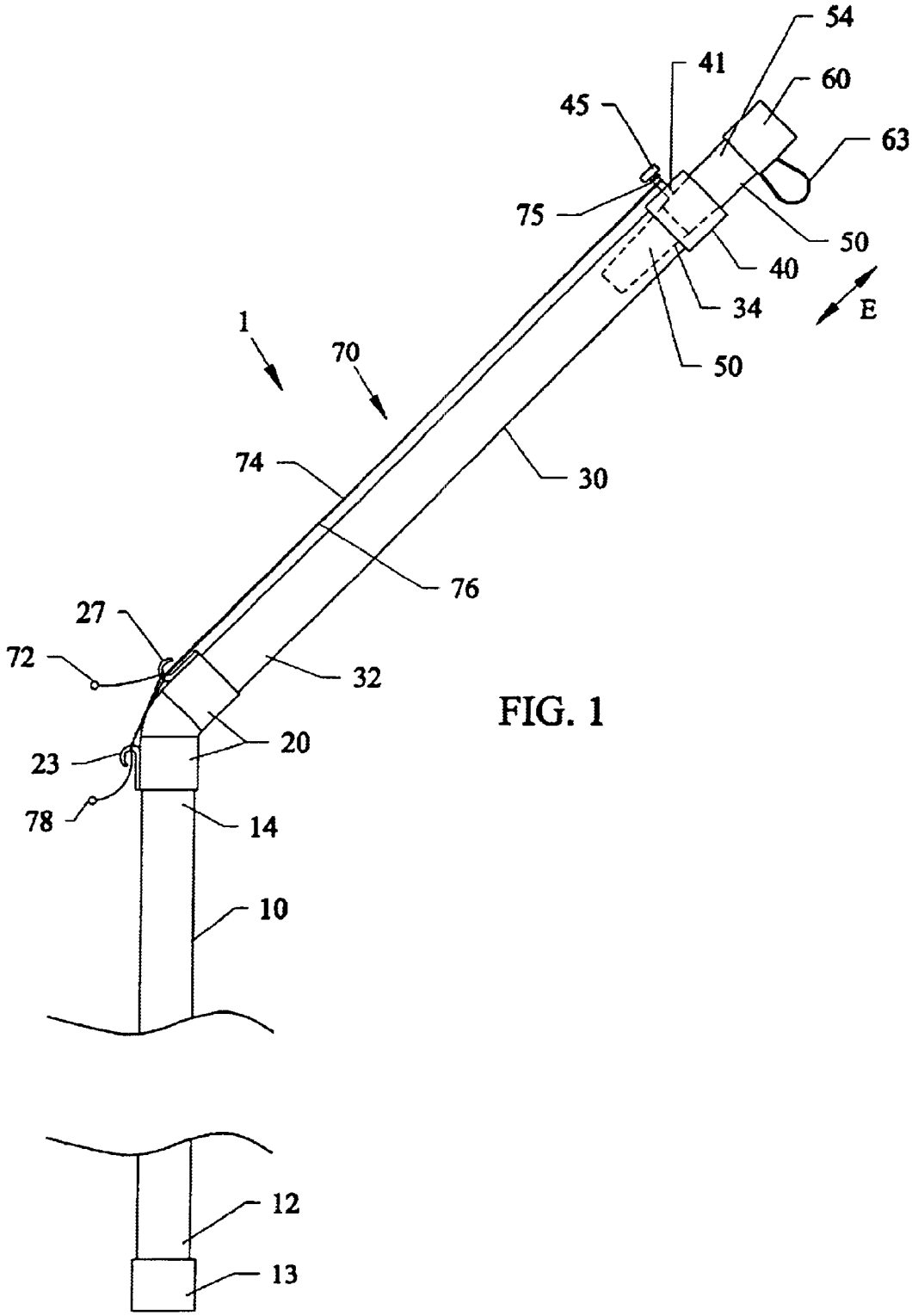
FIG. 1 shows a side view of the novel flag pole and windsock holder of the invention.

FIG. 1 shows a side view of the novel holder 1 for flags and windsocks of the invention. Holder 1 includes a main support tube 10 such as an approximately four foot long hollow PVC pipe, having a bottom end 12 that can include a rubber cap member 13 attached and wrapped about the end 12. Main pipe 10 can include an upper end 14 having an angled connector 20 attached thereon, such as an approximately forty-five degree angled connector formed from PVC, and the like. A first plastic type U-shaped cleat 23 with the cleat opening aimed downward can be affixed to an outer surface of the lower vertical portion of angled connector 20, and a second plastic type cleat 27 with the cleat opening aimed upward can be affixed to an outer surface of the upper angled portion of the angled connector 20. Extending upward from the angled connector 20 can be an end 32 of a second pipe 30 inserted into the angled connector 20.

Second pipe 30 can be approximately one & ½ foot long hollow pipe formed from PVC, and the like. Attached about upper end 34 of second pipe 30 can be another coupler 40 attached thereon. To one side of the coupler 40 can be a adjust lock screw 45, that can also be formed from plastic, and the like, that can screw through a through-hole 41 in the side of the coupler to abut against a side of the third pipe 50.

Third pipe 50 can also be a hollow PVC pipe having a diameter smaller than the diameter of second pipe 30. For example, main pipe 10 and second pipe 20 can each have a diameter of approximately two inches, and third pipe 50 can have an outer diameter of approximately 1 & ½ inches. Pipe 50 can telescopingly be received within end 34 of pipe 30, and extend in either direction as shown by double arrow E to selected extended lengths, where the adjustment screw 45 can be tightened to lock the selected extension of pipe 50. Attached about the upper end 54 of pipe 50 can be a cap member 60 formed from material such as a plastic, rubber, and the like. Attached to cap member 60 can be closed loop 63 such as a plastic tie, rubber band, cord, and the like. Wrapped about the cleats 23, 27, and screw 45 can be a flexible line 70 such as a rope cord, nylon cord, and like. When holder 1 is not being used, line 70 can have one end 72 wrapped about cleat 27 with a first part 74 of line 70 extending upward to wrap in a knot 75 about screw 45, and a second part 76 extending downward to wrap about both cleats 27 and 23, with an end 78 dangling therefrom. When holder 1 is to be used, the line 70 is unwrapped from the cleats 23 and 27.

Figure 2:
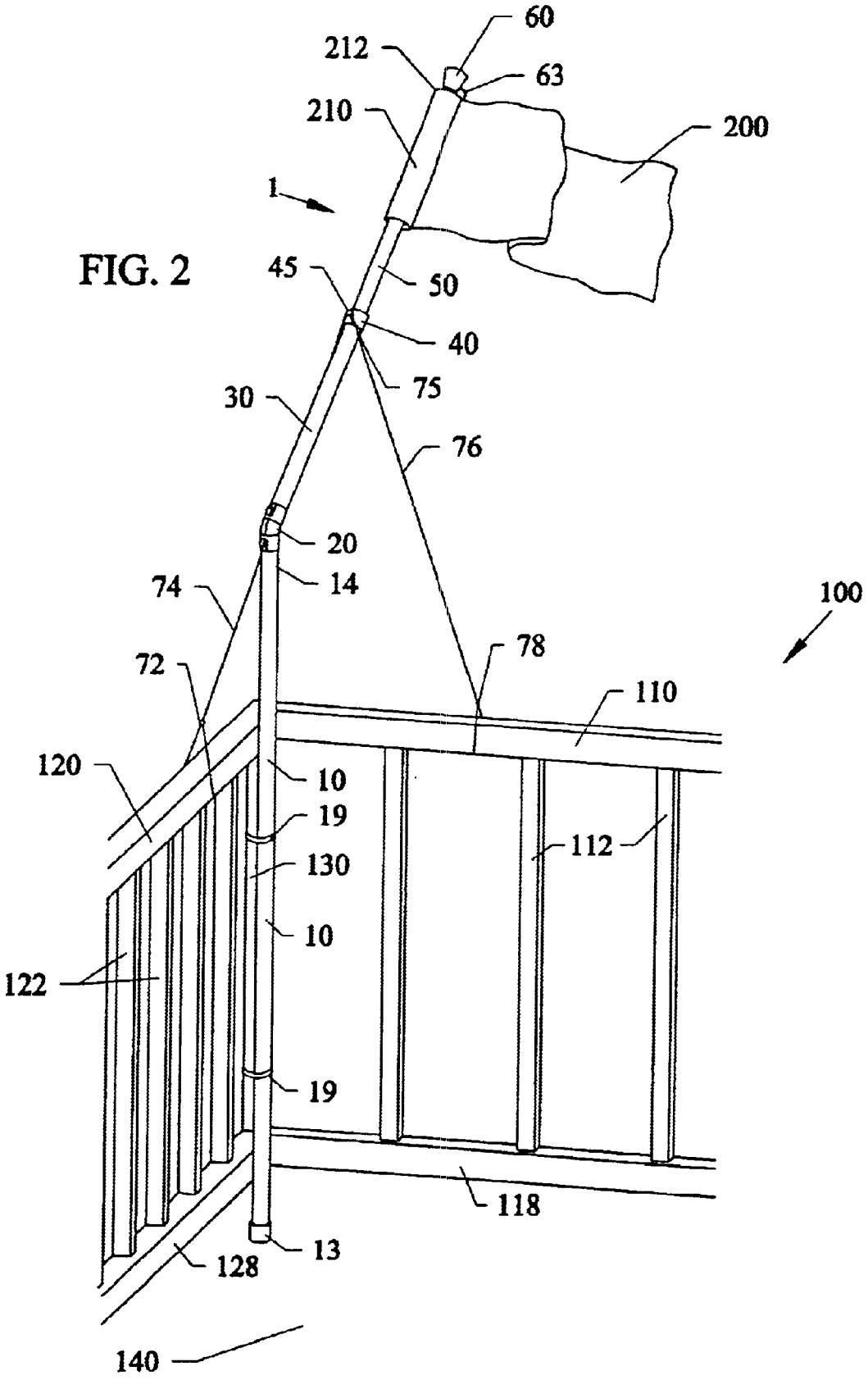
FIG. 2 shows the novel holder of FIG. 1 affixed to a railing with a flag attached.

FIG. 2 shows the novel holder of FIG. 1 affixed to a railing 110, 120 with a flag 200 attached. Railing 110, 120 can be an outer corner of a balcony where two railings 110, 120 meet in a perpendicular configuration to one another at vertical member 130. Railings 110, 120 can have vertical supports 112, 122 connected to lower horizontal railing members 118, 128, respectively. A floor 140 can support the railings 110, 120, vertical supports 112, 122, 130 and lower horizontal members 118, 128. When assembled, main pipe 10 of holder 1, can have the lower cap end 13 sitting on floor 140 so that the weight of holder 1 substantially rests on the floor 140. Main pipe 10 can be attached to vertical member 130 by ties 19, such as but not limited to plastic ties, cord pieces, rubber bands, wires, and the like. Although two ties 19 are shown, less than or more than two ties can be used as needed to secure the main pole 10 in place. Angled connector 20 can be positioned so that second pipe 30 hangs over one or both of the railings 110, 120 to be outside the balcony 100. Third pipe 50 is extended out to a selected extension and locked in place by tightening adjustment screw 45 through connector 40. Flag 200 has sleeve end 210 wrapped about third pipe 50 with loop 63 attached to an upper end 212 of flag sleeve 210 beneath top cap 60. Line section 76 can extend from the knot connection 75 at screw 45 to right handrail 110 with line end 78 attached to right handrail 110. Line end 78 can be attached to railing 110 by a knot wrap, or other techniques such as a clip, and the like. Line section 74 can extend from the knot connection 75 at screw 45 to left handrail 120 with line end 72 attached to right handrail 120. Line end 72 can be attached to railing 120 by a knot wrap, or other techniques such as a clip, and the like. The respective railing attached positions of line ends 72 and 78 to handrails 120, 110 further stabilize and position the second pipe 30 in a selected angled position to overhang outside the balcony 100. Flag 200 can also have sleeve end 210 attached to other points on the holder such as wrapped about second pipe 30, main pipe 10, and the like.

Figure 3:
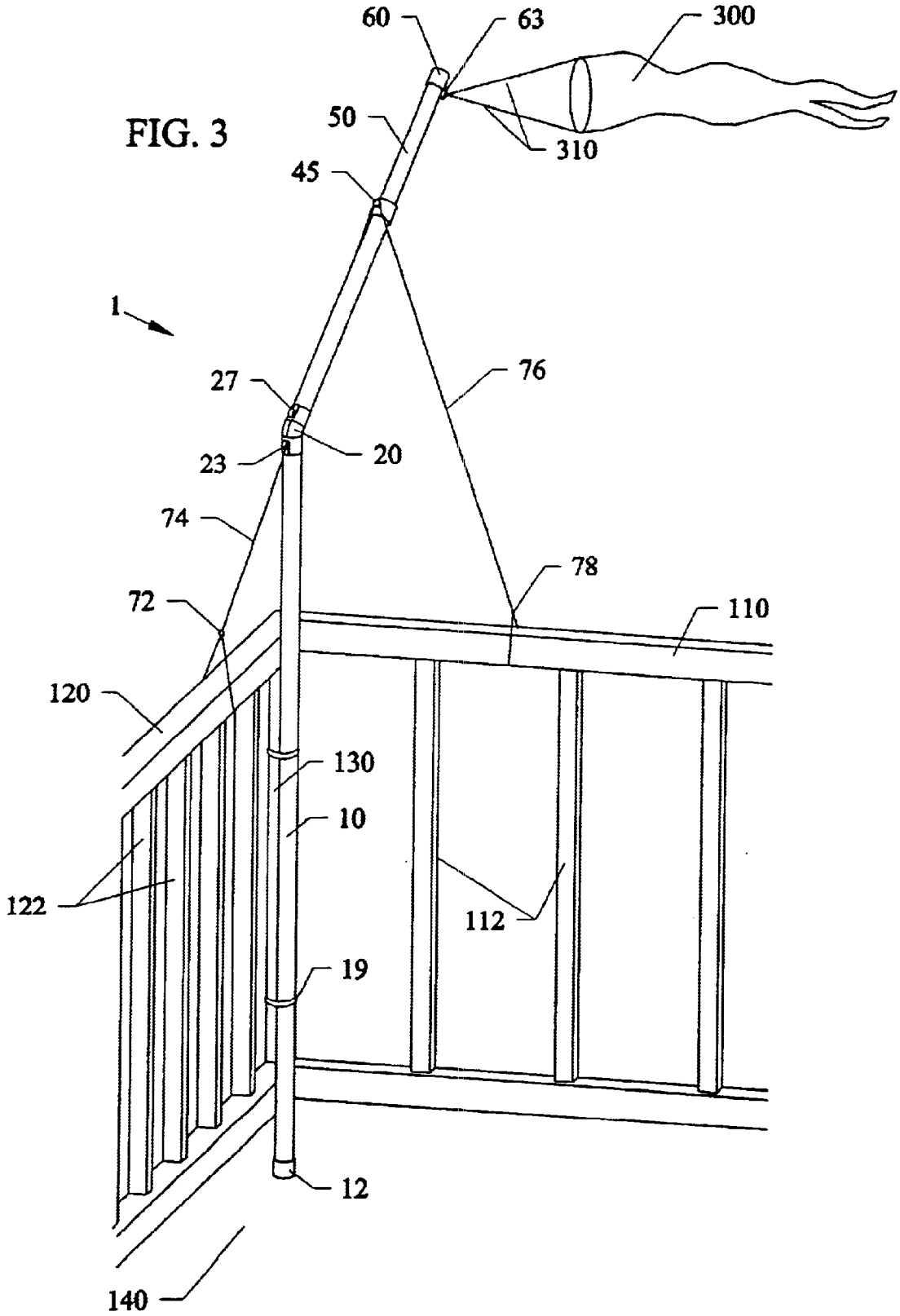
FIG. 3 shows the novel holder of FIG. 1 affixed to a railing with a windsock attached.

FIG. 3 shows the novel holder 1 of FIG. 1 affixed to a railing 110, 120 with a windsock 300 attached. The method of attaching and supporting the holder 1 to the balcony 100 is similar to that described in FIG. 2 above. Referring to FIG. 3, a windsock 300 can have a tie end 310 tied about the loop 63 attached to the cap 60 on top of pipe 50. Additionally, the windsock 300 can be attached to the loop member 63 while the flag 200 is being flown in FIG. 2. Furthermore, the windsock 300 can be attached to other points on the holder 1 such as but not limited to the screw 45, cleats 23, 27, and the like.

For either or both embodiments previously described, a separate stand 400 such as an umbrella stand, and the like, can also be used as a base on a support surface, such as a ground surface, deck surface and the like, having an upper opening 410, for allowing a lower end of the main pole 10 to be supported by the stand 400 without having to use the ties 19 or lines 72–78 when the invention does not need to be attached to a railing. The stand can also be used with the tie lines when extra stability and support is needed.

Although the preferred embodiments show the holder attached to a comer of where two railings meet, the invention can also be separately attached to outer and side railings.

While the preferred embodiments describe attaching the holder 1 to a balcony, the railings can be on a porch, deck, stairwell, and the like.

Although the angled connector is shown as being approximately forty-five degrees, the angled connector can be a perpendicular connector, and have other degrees, and the like.

While the preferred embodiment describes using pole pieces formed from PVC, the invention can be practiced with other materials, such as but not limited to wood, plastic, aluminum, galvanized metal, combinations, thereof, and the like.

Although the holder is described as holding flags and windsocks, the invention can also display other things that can fly in the wind such as but not limited to banners, balloons, and the like.

While the pole for the preferred embodiment appears to be cylindrical, the pole can include other shapes such as but not limited to square cross-sectional shaped, and the like.

Although the preferred embodiment is described for use with balconies, the invention can be used railings on other structures, such as but not limited to porch railings, decks, stairwells.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A flag pole holder for supporting flags to structures having railings, comprising in combination:

a structure having a hand railing above a floor portion, the hand railing having an inside portion facing toward the structure, and an outside portion facing away from the structure about a portion of the structure;

a first longitudinal pole having an upper end portion and a lower end portion resting adjacent to the floor portion, the longitudinal pole being not part of but is separately attached to the hand railing and being substantially perpendicular to the floor portion;

a second longitudinal pole having an upper end and a lower end, the lower end of the second longitudinal pole;

a one-piece single angled pipe connector having a first end and a second end, the first end of the connector being attached to the upper end portion of the first longitudinal pole by being inserted into one another, and the second end of the connector being attached to the lower end of the second longitudinal pole by being inserted into one another, so that the second longitudinal pole is attached off-axis to the first longitudinal pole and extending over the hand railing;

a support line attached to the angled connector and the railing for supporting a selected position of the holder;

cleat means on the single angled pipe connector, the cleat means comprising a first cleat member attached to an upper portion of the connector with an opening facing upward and a second cleat member attached to a lower portion of the connector beneath the first cleat member with an opening facing downward, wherein the support line is wrapped about both the first and the second cleat members; and a flag solely attached to the upper end portion of the second longitudinal pole, wherein the flag is suspended exterior to the outside portion of the hand railing.

2. The flag pole holder of claim 1, wherein the structure includes: a balcony.

3. The flag pole holder of claim 1, further comprising:

means for attaching a windsock to the second longitudinal pole.

4. The flag pole holder of claim 1, wherein the second longitudinal pole further includes:

an upper pole telescopingly connected to a lower pole for allowing the second longitudinal pole to extend to different heights exterior to the outside portion of the hand railing.

5. The flag pole holder of claim 1, wherein the flag pole holder is attached to the railing by: lines.

6. The pole holder of claim 1, wherein the first longitudinal pole, the second longitudinal pole, and the single angled connector each include: PVC pipes.

7. A pole holder for supporting flags and windsocks over hand railings on structures, comprising:

a first longitudinal pole having a lower end which abuts against and does not penetrate a ground surface of a structure inside of a hand railing on the structure and not being past of the structure and the handrail, the first longitudinal pole being substantially perpendicular to the ground surface, and an upper end;

a second longitudinal pole having a lower end and an upper end extending over and outside of the hand railing, the second longitudinal pole being off-axis to the first longitudinal pole;

a one-piece single angled pipe connector having a first end and a second end, the first end of the connected being attached to the upper end portion of the first longitudinal pole by being inserted into one another, and the second end of the connector being attached to the lower end of the second longitudinal pole by being inserted into one another, so that the second longitudinal pole is extending over and outside of the hand railing;

a support line attached to the single angled pipe connector and the railing for supporting a selected position of the holder;

cleat means on the single angled pipe connector, the cleat means comprising a first cleat member attached to an upper portion of the single angled pipe connector with an opening facing upward and a second cleat member attached to a lower portion of the single angled pipe connector beneath the first cleat member with an opening facing downward, wherein the support line is wrapped about both the first and the second cleat members;

a flying means solely attached to a portion of second longitudinal pole adjacent to the upper end of the second longitudinal pole, the flying means extending outward during a wind the flying means is chosen from at least one of: a flag, a banner and a windsock; and at least one of: an additional line for attaching and stabilizing the pole holder to a portion of the structure, and a stand for supporting the pole holder on a ground surface.

8. The pole holder of claim 7, wherein the structure includes: a balcony.

9. The pole holder of claim 7, wherein the second longitudinal pole includes:

an upper pole telescopingly connected to a lower pole for allowing the second longitudinal pole to extend to different heights.

10. The pole holder of claim 7, wherein the first longitudinal pole, the second longitudinal pole, and the single angled connector each include: PVC pipes.

* * * * *